US010855024B2

(12) United States Patent
Humphrey et al.

(10) Patent No.: US 10,855,024 B2
(45) Date of Patent: Dec. 1, 2020

(54) ELECTRICAL CONNECTOR WITH LATCHES AND TERMINAL POSITION ASSURANCE PROJECTIONS PROVIDED ON HINGED COVER

(71) Applicant: TE CONNECTIVITY CORPORATION, Berwyn, PA (US)

(72) Inventors: David Tracy Humphrey, Red Lion, PA (US); Tom Morris, Johnson City, TN (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/173,277

(22) Filed: Oct. 29, 2018

(65) Prior Publication Data

US 2020/0136308 A1 Apr. 30, 2020

(51) Int. Cl.
*H01R 13/627* (2006.01)
*H01R 9/24* (2006.01)
(Continued)

(52) U.S. Cl.
CPC ..... *H01R 13/6273* (2013.01); *H01R 9/2416* (2013.01); *H01R 13/501* (2013.01); *H01R 13/5213* (2013.01)

(58) Field of Classification Search
CPC .. H01R 13/501; H01R 13/115; H01R 13/506; H01R 13/4223; H01R 13/424;
(Continued)

(56) References Cited

U.S. PATENT DOCUMENTS 4,348,070 A 9/1982 Simon
5,545,054 A * 8/1996 Benes ..... H01R 13/422 439/465

(Continued)

FOREIGN PATENT DOCUMENTS

DE 19517431 C1 6/1996
EP 0508196 A2 10/1992

(Continued)

OTHER PUBLICATIONS

"Introducing High Temperature Faston Housings", 2014, 2 pgs., TE Connectivity.

(Continued)

*Primary Examiner* — Edwin A. Leon
*Assistant Examiner* — Matthew T Dzierzynski
(74) *Attorney, Agent, or Firm* — Saxton & Stump, LLC

(57) ABSTRACT

An electrical connector having electrical terminals and a housing. The housing has a terminal-receiving portion with terminal-receiving cavities for receiving the electrical terminals therein. At least one latch-receiving slot is positioned between adjacent terminal-receiving cavities. A cover portion is provided for covering the terminal-receiving cavities and the terminals. The cover portion has latches which cooperate with the at least one latch-receiving slot when the cover portion is moved to a closed position. A hinge portion connects the terminal-receiving portion to the cover portion. The hinge is deformable to allow the cover portion to move between an open position in which the terminals can be inserted and removed from the terminal-receiving cavities of the terminal-receiving portion and the closed position in which the terminals are secured in the terminal-receiving cavities of the terminal-receiving portion.

19 Claims, 5 Drawing Sheets

(51) Int. Cl.
*H01R 13/50* (2006.01)
*H01R 13/52* (2006.01)

(58) Field of Classification Search
CPC .... H01R 13/5829; H01R 4/70; H01R 13/113; H01R 13/42; H01R 13/422; H01R 13/4361; H01R 13/4365; H01R 13/4368; H01R 13/447
See application file for complete search history.

(56) References Cited

U.S. PATENT DOCUMENTS

| | | | | |
|---|---|---|---|---|
| 5,890,935 | A * | 4/1999 | Pill | H01R 13/4368 439/752 |
| 6,024,605 | A | 2/2000 | Beck, Jr. et al. | |
| 6,109,975 | A | 8/2000 | Nitta | |
| 6,837,745 | B2 * | 1/2005 | Takada | H01R 13/562 439/521 |
| 6,921,293 | B2 * | 7/2005 | Takada | H01R 13/5829 439/352 |
| 7,086,908 | B2 * | 8/2006 | Fukuzaki | H01R 13/42 439/521 |
| 8,057,261 | B1 | 11/2011 | DeSio et al. | |
| 9,692,163 | B1 | 6/2017 | Didonato et al. | |
| 10,122,115 | B2 * | 11/2018 | Masuda | H01R 4/70 |
| 10,177,498 | B1 * | 1/2019 | Yi | H01R 13/639 |
| 10,374,334 | B2 * | 8/2019 | Li | H01R 4/184 |
| 2016/0181751 | A1 * | 6/2016 | Affeltranger | H01R 13/514 439/638 |

FOREIGN PATENT DOCUMENTS

| | | | |
|---|---|---|---|
| EP | 0778636 | A1 | 6/1997 |
| GB | 2422728 | B | 1/2009 |
| JP | H10112347 | A | 4/1998 |
| WO | 201500862 | A1 | 1/2015 |

OTHER PUBLICATIONS

Drawing No. C-1969705, Housing, Receptacle, Flag Faston, 6.35, (.250) Series, 3 Position, Rev. B, May 25, 2018, 1 pg., TE Connectivity.
European Search Report, dated Mar. 10, 2020, EP 19 20 5725, Application No. 19205725.5-1201.

* cited by examiner

ELECTRICAL CONNECTOR WITH LATCHES AND TERMINAL POSITION ASSURANCE PROJECTIONS PROVIDED ON HINGED COVER

FIELD OF THE INVENTION

The present invention is directed an electrical connector with a hinged cover to secure one or more terminals in a housing. In particular, the invention is directed to an electrical connector with proper latching and terminal position assurance projections provided on the hinged cover.

BACKGROUND OF THE INVENTION

Receptacle connectors are commonly used devices in various electronics applications. Such devices typically include two primary components: (i) a terminal for receiving and terminating a wire; and (ii) a housing for receiving the terminal. When properly assembled, a wire is inserted and terminated into the terminal, and the terminal is inserted into the housing. A protective cap or cover may be placed over the housing to enclose the wire and terminal. The assembly is then connected or mated to a mating connector or electrical device, as may be appropriate.

In certain applications, hinged connectors may be used, where the cover is integral and hinged to the body of housing of the connector. While hinged connectors are useful, the hinged connectors often fail, as the hinges are relied upon to have mechanical strength to retain the cover and terminals in position. As hinges are designed to easily allow movement of the cover, the hinges do not provide the strength needed to maintain the cover and terminals in position when significant forces are applied to the terminals.

Hinged connectors also fail because the hinged cover does not provide the proper support to retain the terminals in proper position in the housing. The terminals are often allowed to be moved in the housing in a manner which can result in an ineffective electrical connection between the hinged connector and the mating connector.

It would be beneficial to provide a hinged connector in which the cover has sufficient latch features to provide a secure mechanical connection between the cover and the housing without the need to rely on the strength of the hinge. It would also be beneficial to provide a hinged connector in which the cover provides sufficient support to the terminals to prevent the movement of the terminals in the housing to ensure that a proper electrical connection is affected between the hinged connector and the mating connector.

SUMMARY OF THE INVENTION

An embodiment is directed to an electrical connector having electrical terminals and a housing. The housing has a terminal-receiving portion with terminal-receiving cavities for receiving the electrical terminals therein. At least one latch-receiving slot is positioned between adjacent terminal-receiving cavities. A cover portion is provided for covering the terminal-receiving cavities and the terminals. The cover portion has latches which cooperate with the at least one latch-receiving slot when the cover portion is moved to a closed position. A hinge portion connects the terminal-receiving portion to the cover portion. The hinge is deformable to allow the cover portion to move between an open position in which the terminals can be inserted and removed from the terminal-receiving cavities of the terminal-receiving portion and the closed position in which the terminals are secured in the terminal-receiving cavities of the terminal-receiving portion.

An embodiment is directed to an electrical connector having electrical terminals and a housing. The housing has a terminal-receiving portion with terminal-receiving cavities for receiving the electrical terminals therein. At least one latch-receiving slot is positioned between adjacent terminal-receiving cavities. A cover portion is provided for covering the terminal-receiving cavities and the terminals. The cover portion has latches which cooperate with the at least one latch-receiving slot when the cover portion is moved to a closed position. Terminal position assurance projections are provided on the cover portion. The terminal position assurance projections cooperate with the terminals to prevent the movement of the cover portion to the closed position if the terminals are not fully inserted into the terminal-receiving cavities. A hinge portion connects the terminal-receiving portion to the cover portion. The hinge is deformable to allow the cover portion to move between an open position in which the terminals can be inserted and removed from the terminal-receiving cavities of the terminal-receiving portion and the closed position in which the terminals are secured in the terminal-receiving cavities of the terminal-receiving portion.

An embodiment is directed to an electrical connector having electrical terminals and a housing. The housing has a terminal-receiving portion with terminal-receiving cavities for receiving the electrical terminals therein. At least one latch-receiving slot is positioned between adjacent terminal-receiving cavities. The at least one latch-receiving slot has latching shoulders provided at either end thereof. A cover portion is provided for covering the terminal-receiving cavities and the terminals. The cover portion has latches which cooperate with the at least one latch-receiving slot when the cover portion is moved to a closed position. The cover portion has two latches which cooperate with the at least one latch-receiving slot when the cover portion is moved to a closed position. The latches extend from a bottom surface of the cover portion in a direction away from a top surface. The latches are spaced from each other. The latches have resilient arms, lead-in surfaces and locking shoulders. The locking shoulder of a respective latch of the latches faces outwardly in a direction away from the locking shoulder of the other respective latch of the latches. A hinge portion connects the terminal-receiving portion to the cover portion. The hinge is deformable to allow the cover portion to move between an open position in which the terminals can be inserted and removed from the terminal-receiving cavities of the terminal-receiving portion and the closed position in which the terminals are secured in the terminal-receiving cavities of the terminal-receiving portion.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
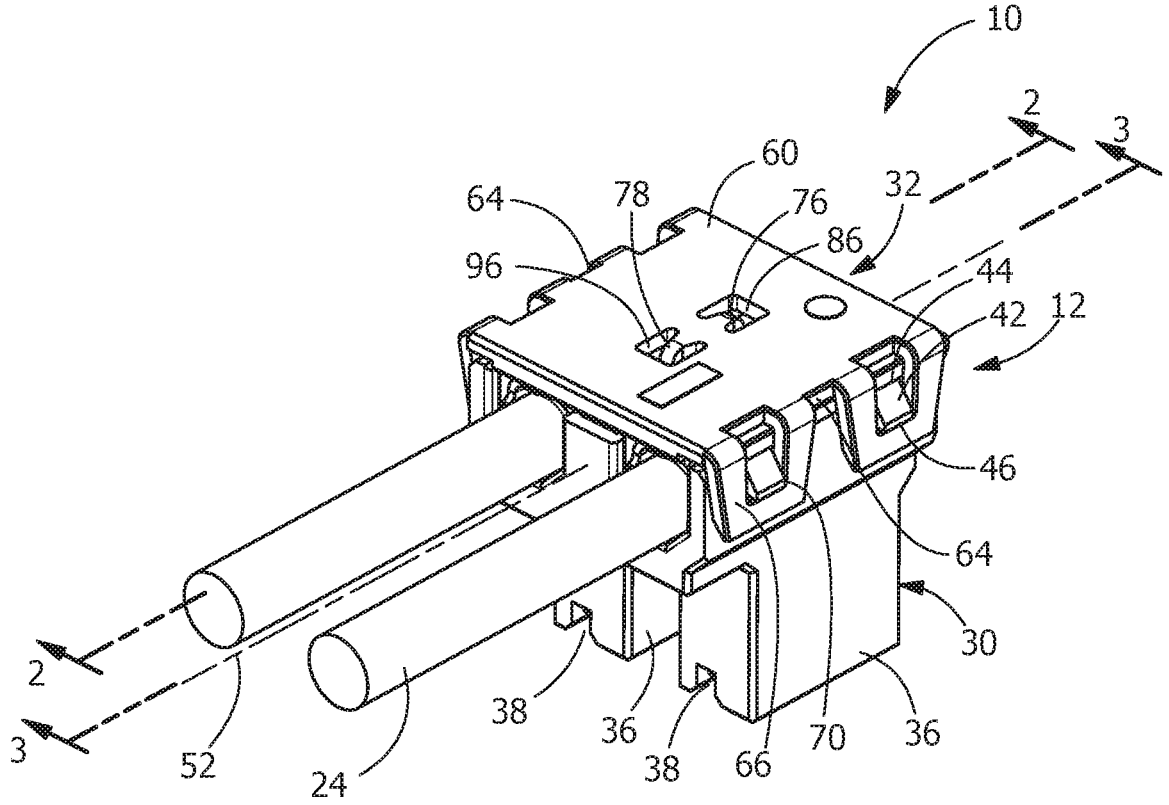
FIG. 1 is a perspective view of an illustrative assembled electrical connector according to the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

Figure 2:
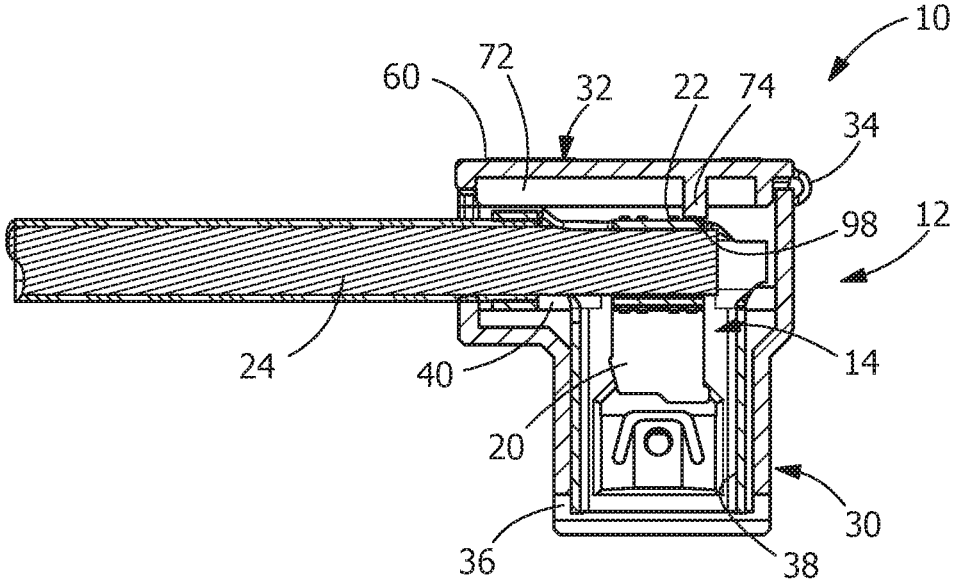
FIG. 2 is a cross-sectional view of the assembled electrical connector taken along line 2-2 of FIG. 1.
Figure 3:
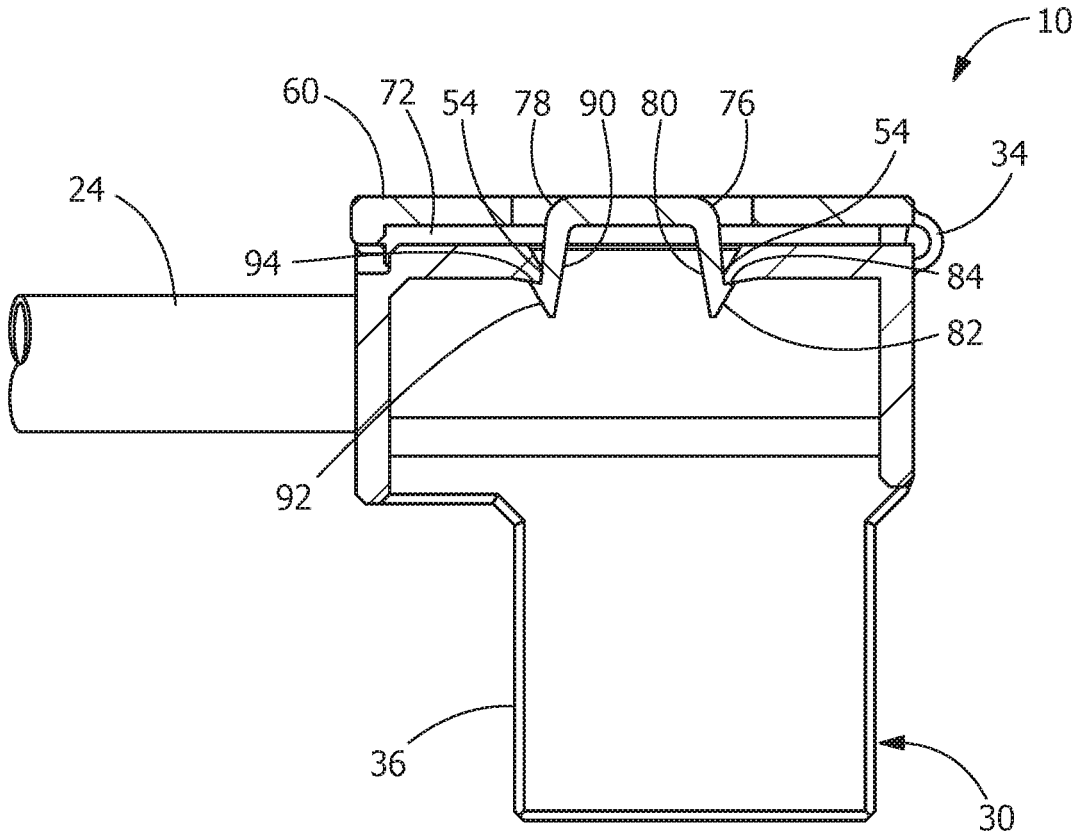
FIG. 3 is a cross-sectional view of the assembled electrical connector taken along line 3-3 of FIG. 1.
Figure 4:
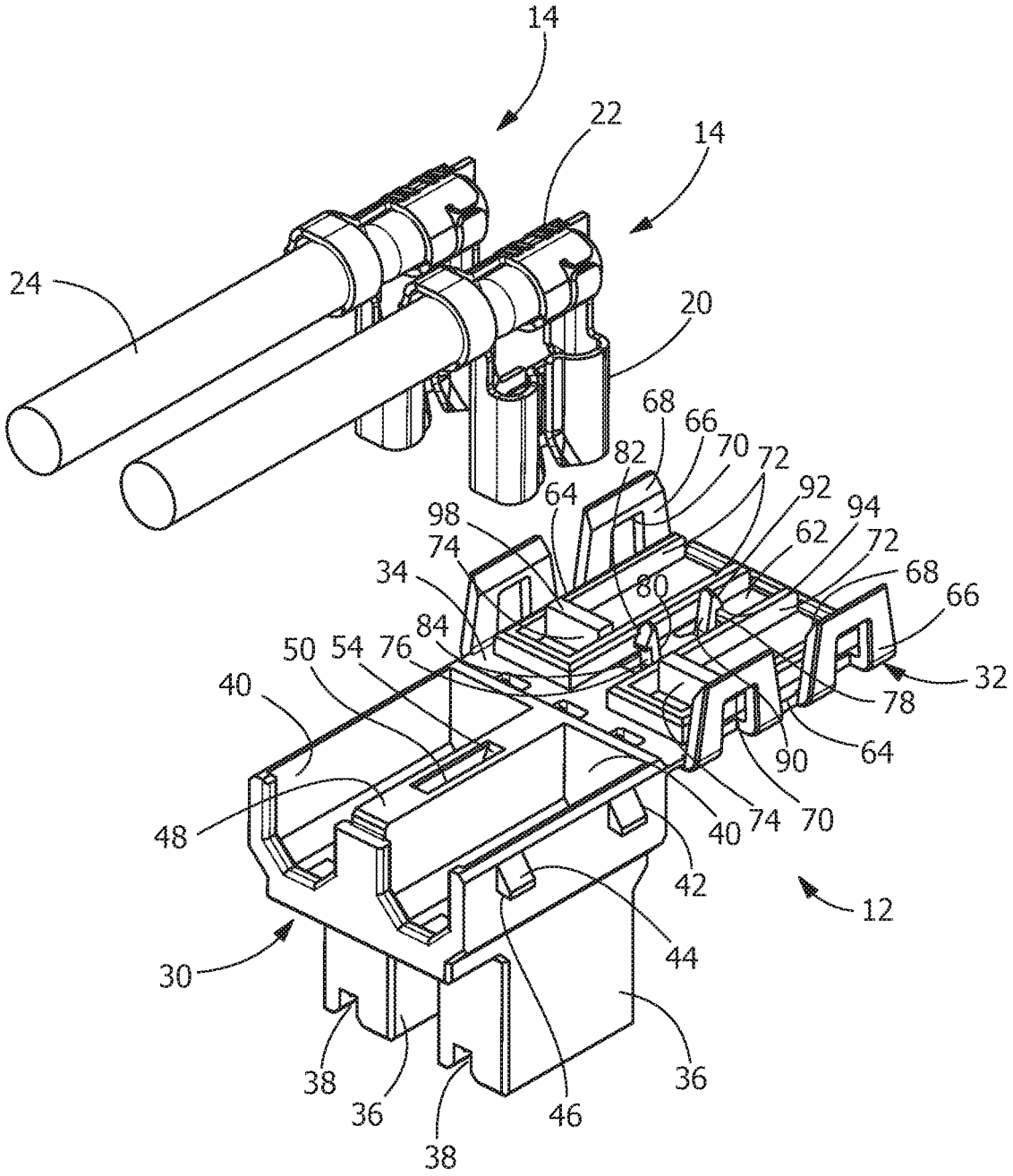
FIG. 4 is an exploded perspective view of the electrical connector of FIG. 1, with a cover portion open and terminals removed from a terminal-receiving portion.
Figure 5:
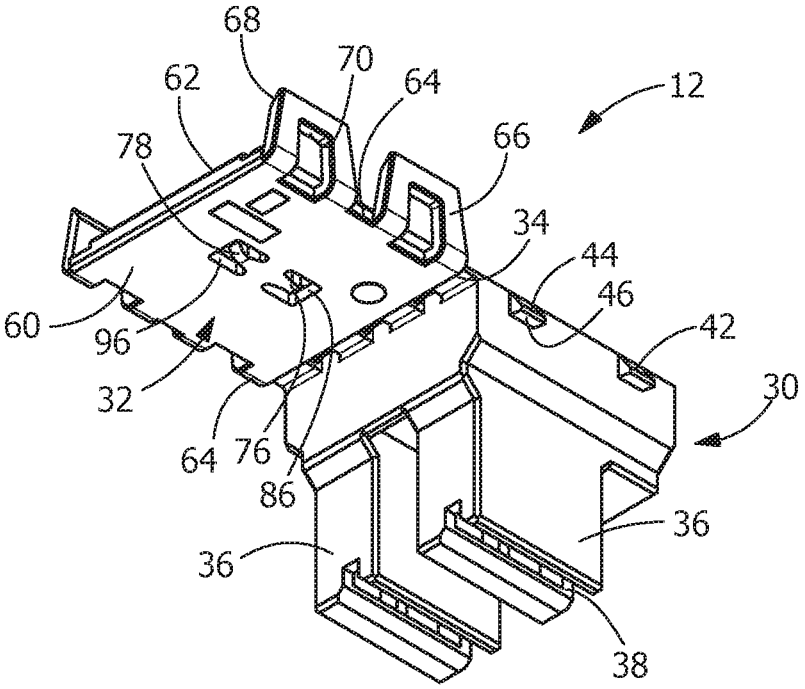
FIG. 5 is a top perspective view of the terminal-receiving portion and the cover portion of the electrical connector shown in FIG. 1.
Figure 6:
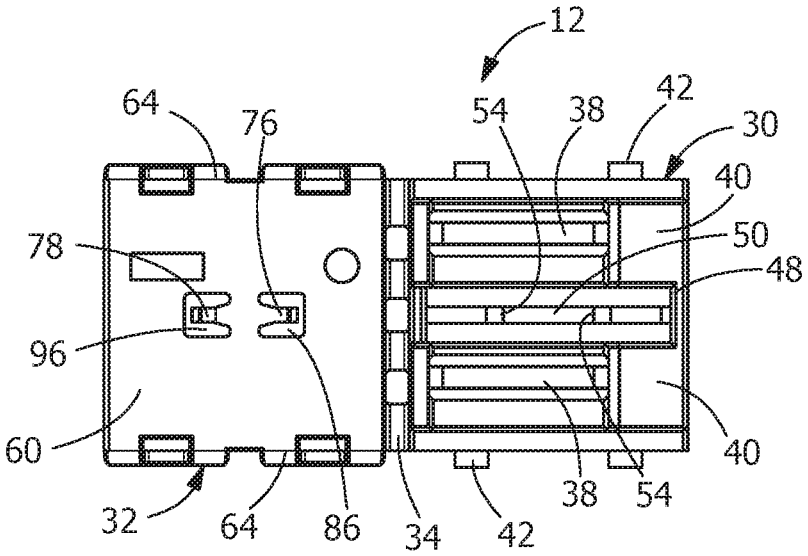
FIG. 6 is a bottom perspective view of the terminal-receiving portion and the cover portion of the electrical connector shown in FIG. 1.
Figure 7:
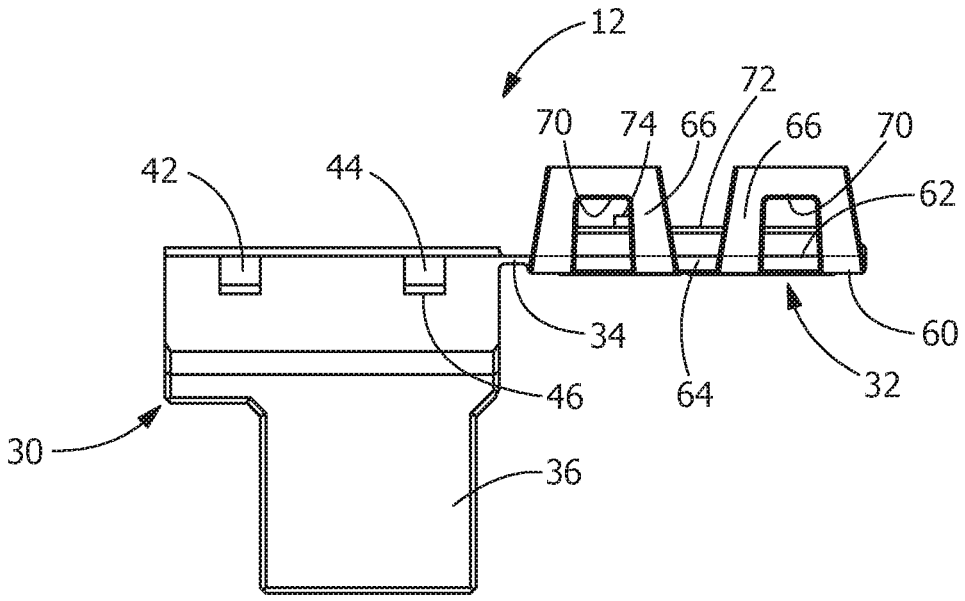
FIG. 7 is a side view the terminal-receiving portion and the cover portion of the electrical connector shown in FIG. 1.

As best shown in FIGS. 1 through 3, an electrical connector 10 includes a housing 12 and electrical terminals 14. The housing 12 is molded from insulating material, such as insulating resin. The electrical terminals 14 are made from conductive materials. In the embodiment shown, two terminals 14 are provided. However, other numbers of terminals 14 may be provided without departing from the scope of the invention.

The terminals 14 have mating portions 20 for mechanically and electrically engaging mating terminals (not shown) and wire-termination portions 22 for terminating conductors or wires 24 thereto. The wires 24 may be terminated to the wire-termination portions by crimping, soldering, welding or other known methods of terminating wires.

As best shown in FIGS. 3 through 6, the connector housing 12 includes a terminal-receiving portion 30, a cover portion 32 and a hinge portion 34 which connects the cover portion 32 to the terminal-receiving portion 30, allowing the terminal-receiving portion 30 and the cover portion 32 to be integrated with each other through hinge portion 34.

In the illustrative embodiment shown, the terminal-receiving portion 30 has two first or rectangular portions 36 which are arranged in parallel at a predetermined distance. Terminal-receiving slots or cavities 38 are provided in the first or rectangular portions 36. The terminal-receiving slots or cavities 38 are dimensioned to receive the mating portions 20 of the terminals 14 therein.

Second or wire-receiving portions 40 are provided in-line with the rectangular portions 36. The second or wire-receiving portions 40 are dimensioned to receive the wire-termination portions 22 of the terminals 14 and the terminated conductors or wires 24 therein. As the wire-termination portions 22 of the terminals 14 and the terminated conductors or wires 24 have a larger cross-sectional area than the mating portions 20 of the terminals 14, the wire-receiving portions 40 have a larger cross-sectional area than the rectangular portions 36.

Outwardly facing or outside lances or latching projections 42 are outward formed on opposite outer surfaces or side walls of the wire-receiving portions 40. In the illustrative embodiment shown, two outside lances or latching projections 42 are formed on the outer surface of each of the wire-receiving portions 40 and extend in a direction away from the terminal-receiving slots or cavities 38. The outside lances or latching projections 42 have sloped lead-in surfaces 44 and locking shoulders 46.

A connection portion 48 is provided between the wire-receiving portions 40. The connection portion 48 has at least one latch-receiving slot 50 which extends in the direction of the longitudinal axis 52 of the housing 12. In the illustrative embodiment shown, the latch-receiving slot 50 is positioned in-line with the longitudinal axis 52 of the housing 12, however, other positions of the latch-receiving slot 50 may be used. The latch-receiving slot 50 has latching shoulders 54 (FIG. 6) provided at either end thereof.

The cover portion 32 has a top surface 60, a bottom surface 62 and side surfaces 64. Resilient locking arms 66 extend from the side surface 64 and extend in a direction beyond the bottom surface 62. The locking arms 66 have sloped lead-in surfaces 68 and locking shoulders 70. In the illustrative embodiment shown, two locking arms 66 are formed on opposed sides surfaces 64 and are positioned to engage the lances or latching projections 42 of the terminal-receiving portion 30.

Extending from the bottom surface 62 of the cover portion 32 in a direction away from the top surface 60 are ribs 72 (FIG. 3). The ribs 72 are configured to be positioned about the periphery of the wire-receiving portions 40 when the cover portion 32 is properly mated with the terminal-receiving portion 30, thereby providing additional strength and rigidity to the electrical connector 10.

Extending from the bottom surface 62 of the cover portion 32 in a direction away from the top surface 60 are terminal position assurance members or projections 74. The terminal position assurance members or projections 74 extend from the bottom surface 62 a greater distance than the ribs 72 extend from the bottom surface 62, as best shown in FIG. 2. The terminal position assurance members or projections 74 are configured to be extend into the wire-receiving portions 40 when the cover portion 32 is properly mated with the terminal-receiving portion 30 to support the terminals 14 and maintain the terminals 14 in proper position, as will be more fully described. In addition, the terminal position assurance members or projections 74 will prevent the cover portion 32 from being moved to the closed position if the terminals 14 are not properly positioned in the terminal-receiving portion 30.

Inside latches 76, 78 extend from the bottom surface 62 of the cover portion 32 in a direction away from the top surface 60. The inside latches 76, 78 are spaced from each other and are positioned to cooperate with the latch-receiving slot 50 when the cover portion 32 is moved to the closed position, as will be more fully described. Inside latch 76 has a resilient arm 80, a lead-in surface 82 and a locking shoulder 84. Inside latch 78 has a resilient arm 90, a lead-in surface 92 and a locking shoulder 94. The locking shoulder 84 of inside latch 76 faces outwardly in a direction away from the inside latch 78. The locking shoulder 94 of inside latch 78 faces outwardly in a direction away from the inside latch 76. Openings 86, 96 extend through the cover portion 32 proximate the respective inside latches 76, 78.

The hinge portion 34 is integrally formed with the terminal-receiving portion 30 and the cover portion 32. The hinge portion 34 is formed so as to be thin enough to be deformable to provide flexibility.

During assembly of the electrical connector 10, the terminals 14 are inserted in the terminal-receiving portion 30 when the cover portion 32 is in an open or first position. The terminals 14 are properly inserted into the terminal-receiving portion 30 when the mating portions 20 of the terminals 14 are positioned in the terminal-receiving slots 38 of the rectangular portions 36 and the wire-termination portions 22 are positioned in the wire-receiving portions 36.

With the terminals 14 inserted into the terminal-receiving portion 30, the cover portion 32 is moved or rotated from the first or open position, as shown in FIG. 3 to the second or closed position, as shown in FIG. 1. As the hinge portion 34 is formed so as to be thin enough to provide flexibility, the movement or rotation of the cover portion 32 about the hinge portion 34 and relative to the terminal-receiving portion 30 is controlled and repeatable.

Figure 8:
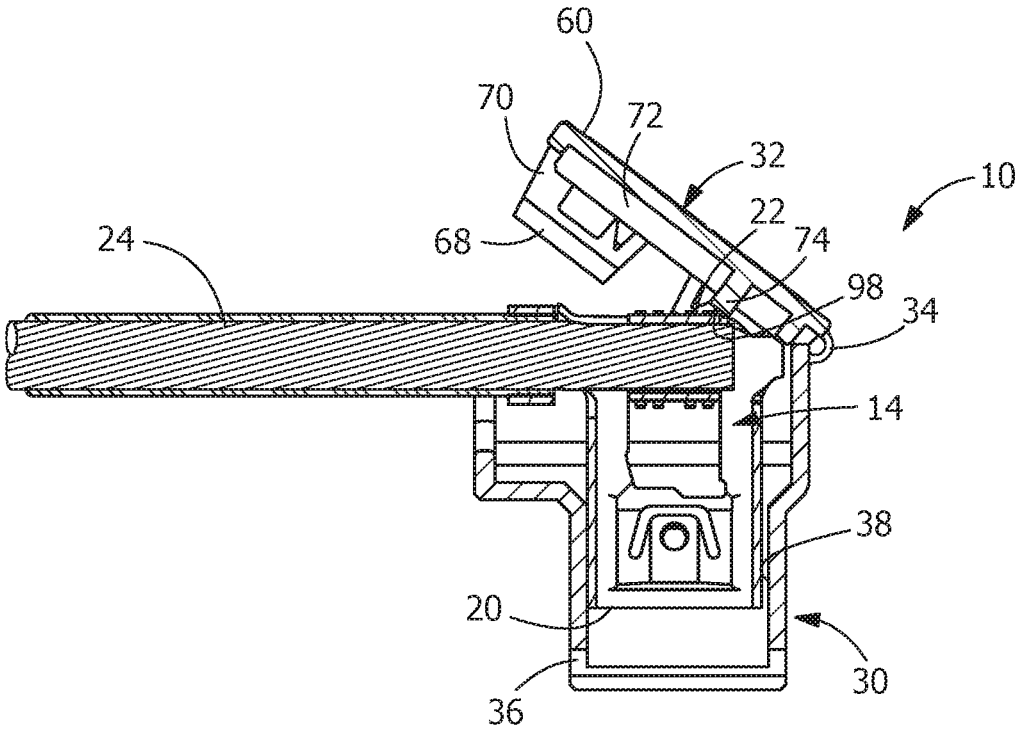
FIG. 8 is a cross-sectional view of the electrical connector of FIG. 1, with a terminal not fully inserted into the terminal-receiving portion and the cover portion unable to be move to a closed position.

As the cover portion 32 is moved from the open position (FIGS. 4 through 7), in which the terminals 14 can be inserted and removed from the terminal-receiving portion 30, toward the closed position (FIGS. 1 through 3), in which the terminals 14 are secured in the terminal-receiving portion 30, the terminal position assurance members or projections 74 will engage the wire-termination portions 22 of the terminals 14 prior to reaching the closed position. If the terminals 14 are properly positioned in the terminal-receiving portion 30, the continued movement of the cover portion 32 to the closed position will cause the engagement of the terminal position assurance members or projections 74 to move or force the wire-termination portions 22, the mating portions 20 and the terminals 14 into proper position in the wire-receiving portions 40 and the rectangular portions of the terminal-receiving portion 30. However, if the terminals 14 are not properly positioned in the terminal-receiving portion 30, the terminals 14 are skewed, or the terminals are prevented from being properly positioned in the terminal-receiving portion 30, the engagement of the terminal position assurance members or projections 74 with the wire-termination portions 22 will prevent the continued movement of the cover portion 32 to the closed position, as illustrated in FIG. 8, thereby providing a visual indication that the electrical connector 10 is not properly terminated.

As the cover portion 32 is moved to the closed position, the inside latch 76 is moved into the latch-receiving slot 50. Continued movement of the cover portion 32 toward the closed position causes the lead-in surface 82 to engage a first latching shoulder 54, forcing the resilient arm 80 to resiliently deform toward inside latch 78. Continued movement of the cover portion 32 toward the closed position causes the lead-in surface 82 to move beyond the first latching shoulder 54 to allow the resilient arm 80 to return toward its unstressed position. As this occurs the locking shoulder 84 of the inside latch 76 of the cover portion 32 and the first latching shoulder 54 of the terminal-receiving portion 30 engage to secure the cover portion 32 to the terminal-receiving portion 30.

As the cover portion 32 is moved to the closed position, the inside latch 78 is moved into the latch-receiving slot 50. This occurs simultaneously with, or slight after, the inside latch 76 being moved into the latch-receiving slot 50. Continued movement of the cover portion 32 toward the closed position causes the lead-in surface 92 to engage a second latching shoulder 54, forcing the resilient arm 90 to resiliently deform toward inside latch 76. Continued movement of the cover portion 32 toward the closed position causes the lead-in surface 92 to move beyond the second latching shoulder 54 to allow the resilient arm 90 to return toward its unstressed position. As this occurs the locking shoulder 94 of the inside latch 78 of the cover portion 32 and the second latching shoulder 54 of the terminal-receiving portion 30 engage to secure the cover portion 32 to the terminal-receiving portion 30.

The movement of the inside latch 76 toward the inside latch 78 and the movement of the inside latch 78 toward the inside latch 76 as the cover portion 32 is moved toward the closed position is important to prevent the binding or stubbing of the inside latches 76, 78 during rotation or movement of the cover portion 32.

At the same time as the inside latches 76, 78 are cooperating with the latch-receiving slot 50. The resilient locking arms 66 of the cover portion 32 cooperate with the outside latches 42 of the terminal-receiving portion 30 to secure the cover portion 32 to the terminal-receiving portion 30. The movement of the cover portion 32 toward the closed position causes the lead-in surfaces 68 of the resilient locking arms 66 to engage the lead-in surfaces 44 of the outside lances or latching projections 42, forcing the resilient locking arms 66 to resiliently deform toward outward. Continued movement of the cover portion 32 toward the closed position causes the lead-in surfaces 68 to move beyond the lead-in surfaces 44 to allow the resilient locking arms 66 to return toward their unstressed position. As this occurs the locking shoulders 70 of the resilient locking arms 66 of the cover portion 32 and the locking shoulders 46 of the terminal-receiving portion 30 engage to secure the cover portion 32 to the terminal-receiving portion 30.

The cooperation of the inside latches 76, 78 with the latch-receiving slot 50 and the cooperation of the resilient locking arms 66 with the outside latches 42 properly secure the cover portion 32 to the terminal-receiving portion 30 and provide the proper mechanical support to prevent the inadvertent movement of the cover portion 32 from the closed position to the open position. While the hinge portion 34 allows the cover portion 32 to move or pivot about the terminal-receiving portion 30, the ability of the cover portion 32 to be retained on the terminal-receiving portion 30 does not rely on the strength of the hinge portion.

As best shown in FIG. 2, when the cover portion 32 is properly moved and secured in the closed position, the terminal position assurance members or projections 74 cooperate with the wire-termination portions 22 of the terminals 14 to prevent or limit the movement of the terminals 14 toward the cover portion 32. The positioning of the terminal position assurance members or projections 74 in-line with the mating portions 20 is important to maintain the proper position of the terminals 14 in the terminal-receiving slots 38 of the terminal-receiving portion 30 of the housing 12 of the connector 10. Consequently, as the mating portions 20 engage a mating terminal (not shown), the mating portions 20 and the terminals 14 will remain in the position shown in FIG. 2, thereby helping to ensure that a proper electrical connection is made and maintained between the terminals 14 and the mating terminals. As the terminal position assurance members or projections 74 have only small surfaces 98 which are optimally positioned to cooperate with the wire-termination portions 22 of the terminals 14 , the dimensional tolerances of the terminal position assurance members or projections 74 can be properly controlled during manufacture without significant additional cost.

The electrical connector 10 of the present invention allows ease of assembly and disassembly of the housing 12 and terminals 14, thereby allowing repairs to the terminals 14. As the cover portion 32 ensures that the terminals are properly positioned at insertion and are maintained in proper position during mating and use, the electrical connector 10 provides for a reliable and cost effective electrical connection.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector comprising:

electrical terminals;

a housing comprising;

a terminal-receiving portion having terminal-receiving cavities for receiving the electrical terminals therein, at least one latch-receiving slot positioned between adjacent terminal-receiving cavities, latching projections extend from the terminal-receiving portion;

a single piece cover portion for covering the terminal-receiving cavities and the terminals, the cover portion having a top surface, an oppositely facing bottom surface and side surfaces, the cover portion having latches which extend from the bottom surface in a direction away from the top surface, the latches cooperate with the at least one latch-receiving slot when the cover portion is moved to a closed position, openings extend through the cover portion proximate the latches, resilient locking arms extend from the side surfaces and extend in a direction beyond the bottom surface, the locking arms engage the latching projections of the terminal-receiving portion;

a hinge portion connecting the terminal-receiving portion to the cover portion, the hinge being deformable to allow the cover portion to move between an open position in which the terminals can be inserted and removed from the terminal-receiving cavities of the terminal-receiving portion and the closed position in which the terminals are secured in the terminal-receiving cavities of the terminal-receiving portion.

2. The electrical terminal as recited in claim 1, wherein the latches are two latches which extend from a bottom surface of the cover portion in a direction away from a top surface, the latches are spaced from each other.

3. The electrical terminal as recited in claim 2, wherein the latches have resilient arms, lead-in surfaces and locking shoulders, the locking shoulder of a respective latch of the latches faces outwardly in a direction away from the locking shoulder of another respective latch of the latches.

4. The electrical terminal as recited in claim 3, wherein the at least one latch-receiving slot has latching shoulders provided at either end thereof which cooperate with the locking shoulders to maintain the cover portion in the closed position.

5. The electrical terminal as recited in claim 4, wherein the at least one latch-receiving slot extends in the direction of a longitudinal axis of the housing.

6. The electrical terminal as recited in claim 5, wherein the at least one latch-receiving slot is positioned in-line with the longitudinal axis of the housing.

7. The electrical terminal as recited in claim 1, wherein the terminal-receiving portion has latching projections are positioned on sidewalls of the terminal-receiving portion, the latching projections extend from the sidewalls in a direction away from the terminal-receiving cavities.

8. The electrical terminal as recited in claim 7, wherein the cover portion has locking arms which cooperate with the latching projections when the cover portion is moved to the closed position, the cooperation of the latches with the at least one latch-receiving slot and the cooperation of the locking arms with the latching projections maintains the cover portion in the closed position.

9. The electrical terminal as recited in claim 1, wherein the terminal-receiving portion has two rectangular portions are arranged in parallel, the terminal-receiving cavities are provided in the rectangular portions.

10. The electrical terminal as recited in claim 9, wherein wire-receiving portions are provided in-line with the rectangular portions, the wire-receiving portions are dimensioned to receive wire-termination portion of the terminals, the wire-receiving portions have a larger cross-sectional area than the rectangular portions.

11. The electrical terminal as recited in claim 10, wherein terminal position assurance projections are provided on the cover portion, the terminal position assurance projections cooperate with the terminals to prevent the movement of the cover portion to the closed position if the terminals are not fully inserted into the terminal-receiving cavities.

12. The electrical terminal as recited in claim 11, wherein ribs extend from a bottom surface of the cover portion in a direction away from a top surface, the ribs are configured to be positioned about the periphery of the wire-receiving portions when the cover portion is in the closed position.

13. The electrical terminal as recited in claim 12, wherein the terminal position assurance projections extend from the bottom surface of the cover portion in a direction away from the top surface, the terminal position assurance projections extend from the bottom surface a greater distance than the ribs extend from the bottom surface, the terminal position assurance projections are configured to be extend into the wire-receiving portions when the cover portion is properly mated with the terminal-receiving portion to support the terminals and maintain the terminals in proper position.

14. An electrical connector comprising:

electrical terminals;

a housing comprising;

a terminal-receiving portion having terminal-receiving cavities for receiving the electrical terminals therein, at least one latch-receiving slot positioned between adjacent terminal-receiving cavities;

a cover portion for covering the terminal-receiving cavities and the terminals, the cover portion having latches which cooperate with the at least one latch-receiving slot when the cover portion is moved to a closed position, openings extend through the cover portion proximate the latches, terminal position assurance projections provided on the cover portion, the terminal position assurance projections cooperating with the terminals to prevent the movement of the cover portion to the closed position if the terminals are not fully inserted into the terminal-receiving cavities;

a hinge portion connecting the terminal-receiving portion to the cover portion, the hinge being deformable to allow the cover portion to move between an open position in which the terminals can be inserted and removed from the terminal-receiving cavities of the terminal-receiving portion and the closed position in which the terminals are secured in the terminal-receiving cavities of the terminal-receiving portion.

15. The electrical terminal as recited in claim 14, wherein the latches are two latches which extend from a bottom surface of the cover portion in a direction away from a top surface, the latches are spaced from each other.

16. The electrical terminal as recited in claim 15, wherein the latches have resilient arms, lead-in surfaces and locking shoulders, the locking shoulder of a respective latch of the latches faces outwardly in a direction away from the locking shoulder of another respective latch of the latches.

17. The electrical terminal as recited in claim 16, wherein the at least one latch-receiving slot has latching shoulders provided at either end thereof which cooperate with the locking shoulders to maintain the cover portion in the closed position.

18. An electrical connector comprising:

electrical terminals;

a housing comprising;

a terminal-receiving portion having terminal-receiving cavities for receiving the electrical terminals therein and wire-receiving portions are for receiving wire-termination portions of the terminals, at least one latch-receiving slot positioned between adjacent terminal-receiving cavities;

a cover portion for covering the terminal-receiving cavities and the terminals, the cover portion having latches which cooperate with the at least one latch-receiving slot when the cover portion is moved to a closed position, ribs extend from a bottom surface of the cover portion in a direction away from a top surface, the ribs are configured to be positioned about the periphery of the wire-receiving portions when the cover portion is in the closed position, the terminal position assurance projections cooperating with the terminals to prevent the movement of the cover portion to the closed position if the terminals are not fully inserted into the terminal-receiving cavities, the terminal position assurance projections extend from the bottom surface in a direction away from the top surface, the terminal position assurance projections extend from the bottom surface a greater distance than the ribs extend from the bottom surface;

a hinge portion connecting the terminal-receiving portion to the cover portion, the hinge being deformable to allow the cover portion to move between an open position in which the terminals can be inserted and removed from the terminal-receiving cavities of the terminal-receiving portion and the closed position in which the terminals are secured in the terminal-receiving cavities of the terminal-receiving portion.

19. The electrical terminal as recited in claim 18, wherein terminal position assurance projections extend from the bottom surface of the cover portion in a direction away from the top surface, the terminal position assurance projections are configured to extend into the terminal-receiving portion when the cover portion is properly mated with the terminal-receiving portion to support the terminals and maintain the terminals in proper position.

* * * * *